United States Patent [19]

Moertel

[11] 4,236,683

[45] Dec. 2, 1980

[54] COUPLING ELEMENT FOR SLIDE FASTENER AND METHOD OF MANUFACTURE

[75] Inventor: George B. Moertel, Conneautville, Pa.

[73] Assignee: Textron Inc., Providence, R.I.

[21] Appl. No.: 689,414

[22] Filed: May 24, 1976

[51] Int. Cl.[2] ..... A44B 19/02

[52] U.S. Cl. ..... 24/205.13 R

[58] Field of Search ..... 24/205.13 R, 205.13 D

[56] References Cited

U.S. PATENT DOCUMENTS

| | | | |
|---|---|---|---|
| 1,669,922 | 5/1928 | Anderegg | 24/205.13 R |
| 2,068,354 | 1/1937 | Seaver | 24/205.13 R |
| 3,886,634 | 6/1975 | Murata | 24/205.13 R |

FOREIGN PATENT DOCUMENTS

| | | | |
|---|---|---|---|
| 2143986 | 3/1972 | Fed. Rep. of Germany | 24/205.13 R |

OTHER PUBLICATIONS

A.P.C. Application of Kohl, Ser. No. 328,113, Published Apr. 27, 1943.

*Primary Examiner*—Kenneth Dorner
*Attorney, Agent, or Firm*—O'Brien & Marks

[57] ABSTRACT

A coupling element, such as a scoop formed from a synthetic polymer, for a slide fastener includes a head with a triangular side cross section bounded by a top surface and two downwardly converging bottom surfaces which extend at equal angles relative to legs of the coupling element. Leg sections adjacent the head are disclosed as being formed with oriented polymer for increased strength.

9 Claims, 11 Drawing Figures

FIG. 1
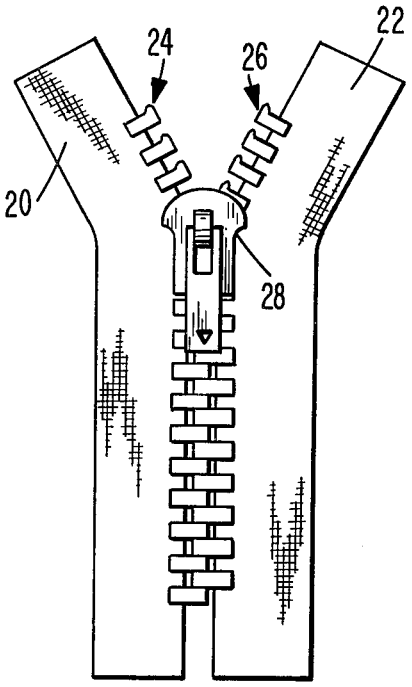
FIG. 2
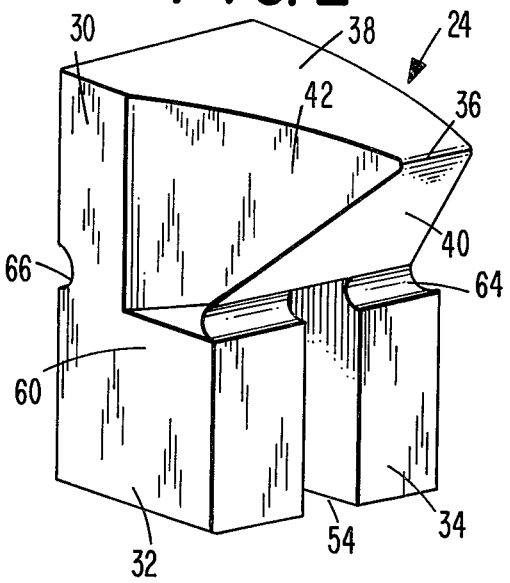
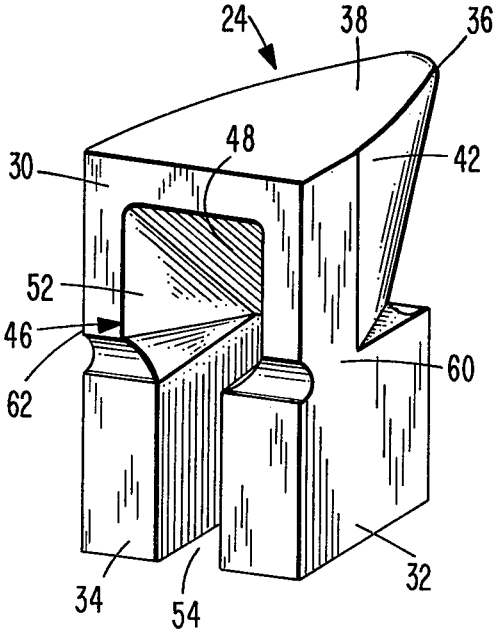
FIG. 3
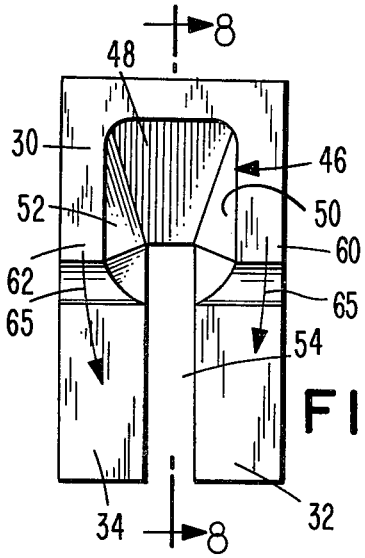
FIG. 4
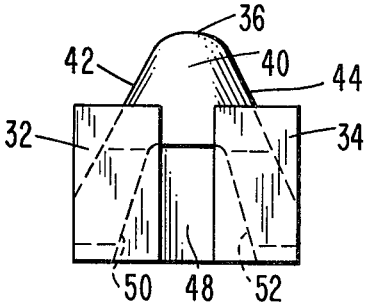
FIG. 5

COUPLING ELEMENT FOR SLIDE FASTENER AND METHOD OF MANUFACTURE

BACKGROUND OF THE INVENTION

1. Field of the Invention

The invention relates to slide fasteners and particularly to coupling elements for slide fasteners and their methods of manufacture.

2. Description of the Prior Art

One common slide fastener employs metal scoops or coupling elements wherein each of the metal scoops has a tapered projection from the front thereof and a similarly shaped recess in the rear thereof for receiving the projection of a mating scoop; the tapered projection and the recess being in alignment parallel to the tape to which the metal scoop is secured. The bottom surface of the tapered projection on the scoop is thus substantially closer to the edge of the tape than the top of the recess such that the crosswise forces on the slide fastener tend to pivotally stress the coupling element causing longitudinal stress on the edge of the tape.

SUMMARY OF THE INVENTION

The invention is summarized in a coupling element for a slide fastener including a head, leg means extending from the head, the head having a side cross section which is generally triangular and bounded by a top surface and two downwardly converging bottom surfaces, and at least a portion of the bottom surfaces of the head being engaged by opposite bottom surfaces of mating coupling elements.

An object of the invention is to construct a coupling element for a slide fastener having an improved uniformity of stress loading of the element.

Another object of the invention is to provide a coupling element aesthetically similar to metal scoops but having a specific geometry to permit manufacture with synthetic resins as well as requiring less material.

It is also an object of the invention to design a coupling element with a front locking projection and a back locking recess or pocket wherein the front and back coupling or loading surfaces are equidistant from the edge of a supporting tape.

An additional feature of the invention is an open pocket in the coupling element.

Another feature of the invention is the orientation of a polymer resin in leg sections adjacent the head of the coupling element producing increased strength.

Other objects, advantages and features of the invention will be apparent from the following description of the preferred embodiment taken in conjunction with the accompanying drawings.

BRIEF DESCRIPTION OF THE DRAWINGS

FIG. 1 is a plan view of a slide fastener constructed in accordance with the invention.

FIG. 2 is a perspective view of a coupling element of the slide fastener of FIG. 1.

FIG. 3 is a perspective view of the element of FIG. 2 taken from a different angle.

FIG. 4 is a back view of the element of FIGS. 2 and 3.

FIG. 5 is a bottom view of the element of FIGS. 2, 3 and 4.

DESCRIPTION OF THE PREFERRED EMBODIMENT

Figure 6:
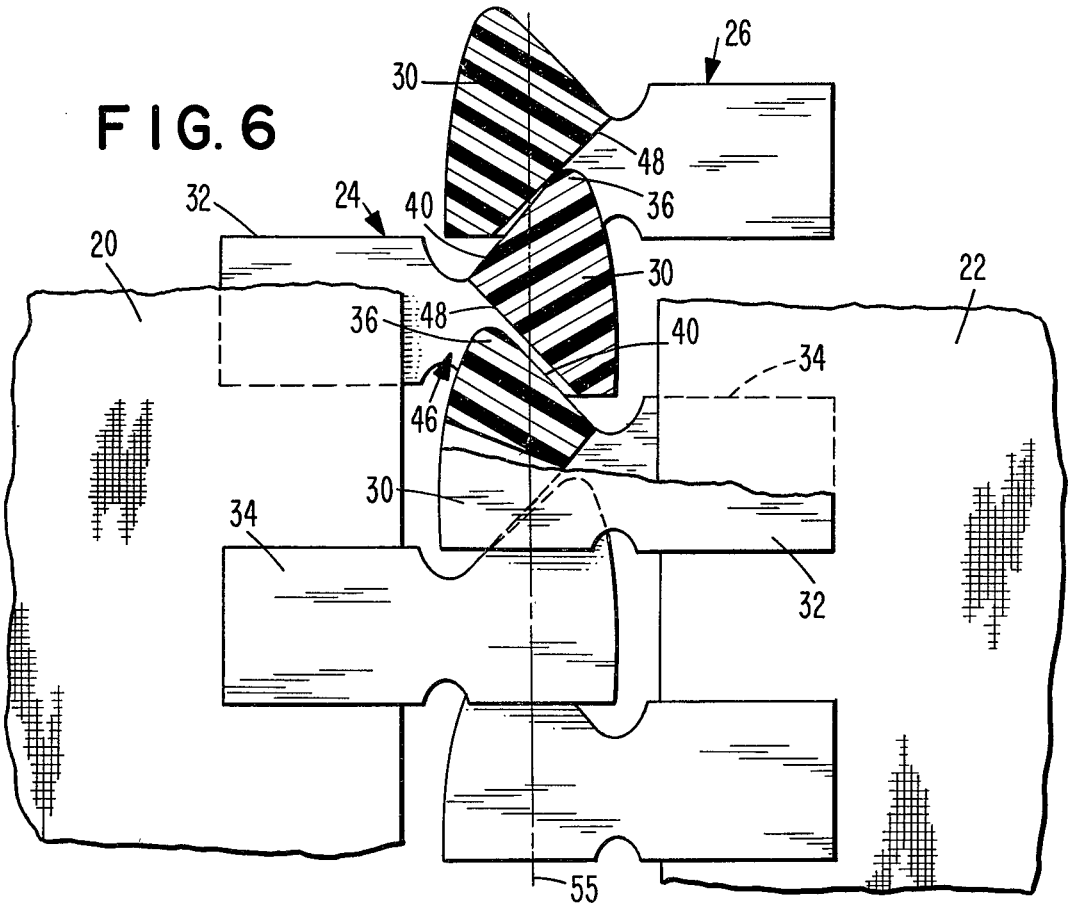
FIG. 6 is an enlarged plan view, partially in cross section, of a broken away portion of the fastener of FIG. 1 in an unloaded state.

As illustrated in FIG. 1, a slide fastener manufactured in accordance with the invention includes a pair of carrier tapes 20 and 22 with rows of respective pluralities of interlocking coupling elements 24 and 26 secured to the inner edges of the tapes 20 and 22. A slider 28 is slidably mounted on the coupling elements 24 and 26 for opening and closing the coupling elements. The tape 20 and coupling elements 24 form a left stringer, while the tape 22 and the coupling elements 26 form a right stringer. The left and right stringers are substantially mirror images of each other and together form a slide fastener chain.

As shown in FIGS. 2–5, each of the coupling elements 24 (and the coupling elements 26, FIGS. 6 and 7) has a head 30 and a pair of parallel spaced legs 32 and 34 extending downward from opposite sides of the head 30. A tapered locking protrusion or projection 36 is formed on the front of the head 30 and is defined by a generally horizontal top surface 38 of the element 24, a bottom surface 40 on the head 30 sloping upward from the front of the legs 32 and 34, and a pair of converging side surfaces 42 and 44 extending from about midway of the sides of the respective legs 32 and 34. A locking recess or pocket indicated generally at 46 in the back of the element 24 is bordered by a bottom inside surface 48 of the head 30 sloping downwardly from the rear of the element 24, and a pair of inside vertical surfaces 50 and 52 converging inwardly from the rear of the element 24. The bottom of the recess 46 opens into a slit 54 between the legs 32 and 34. As viewed in FIG. 8, the head 30 has a side cross section which is generally triangular and bounded by the surfaces 38, 40 and 48; the surfaces 40 and 48 converging downwardly at substantially the same angle relative to the horizontal or to the legs 32 and 34 and converging at a point adjacent the front of the legs 32 and 34. Also midpoints of the surfaces 40 and 48 define a straight line 55, FIGS. 6 and 7, generally perpendicular to the legs 32 and 34.

Figure 7:
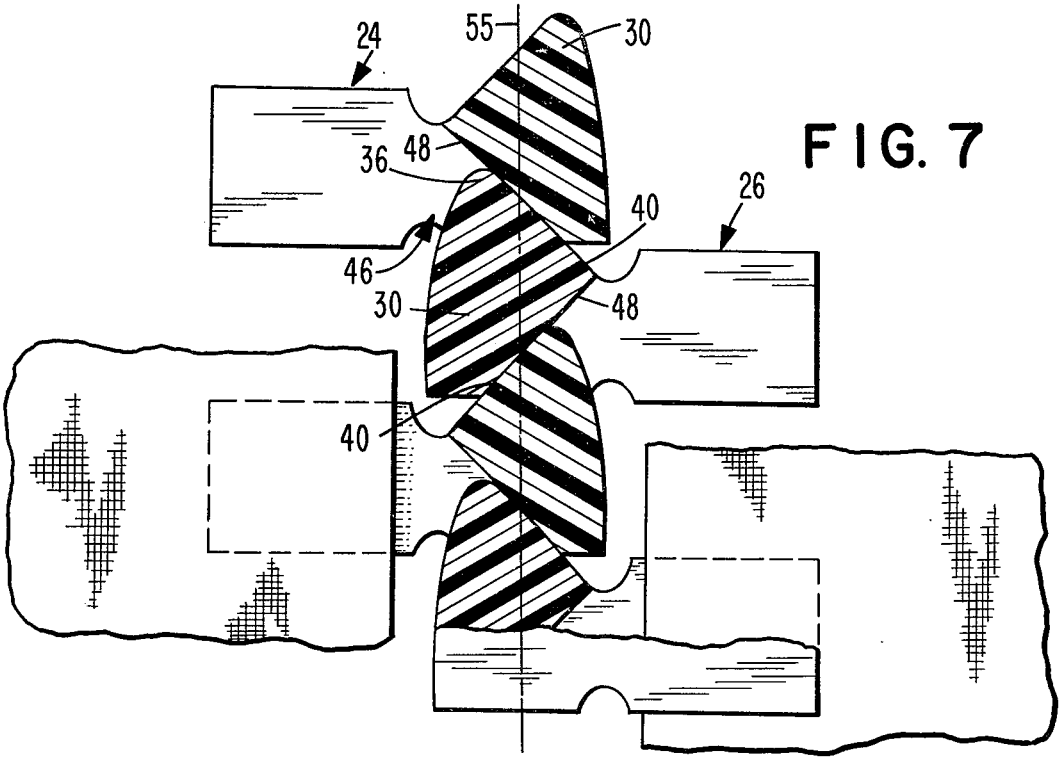
FIG. 7 is a view similar to FIG. 6, but with the fastener in a loaded state.
Figure 8:
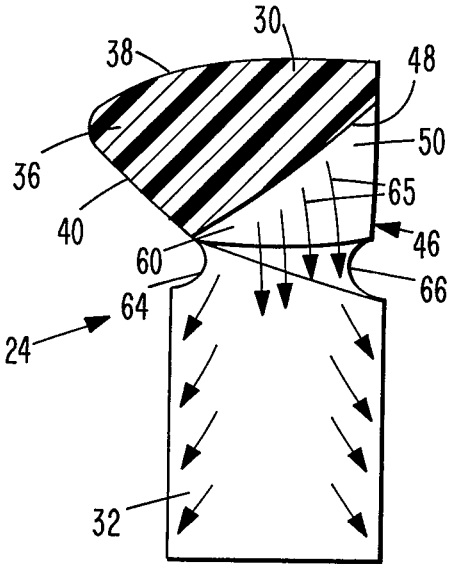
FIG. 8 is a side cross section view taken along line 8—8 in FIG. 4.

In forming the chain in FIGS. 1, 6 and 7 the elements 24 and 26 are positioned with the inner edges of the tapes 20 and 22 received within the slots 54, FIG. 4, and between the leg portions 32 and 34. The heads 30 are spaced from the tapes 20 and 22 with the legs 32 and 34 extending perpendicular to the edges of the tapes. The coupling elements 24 and 26 are secured to the tapes 20 and 22 in a suitable manner, such as by adhesive bonding, ultrasonic bonding, dielectric bonding, or otherwise securing the legs 32 and 34.

The particular construction of the coupling element with a front locking projection and a rear locking pocket which opens into the slit 54 between the legs, thus forming an open pocket, results in utilization of less material for forming the coupling element as well as allowing leg to leg flexibility and relatively easy attachment to the tape. The increased flexibility allows for distribution of stress between the legs.

As shown in FIGS. 6 and 7, the projections 36 of the coupling elements 24 mate with the recesses 46 in the rear of the mating coupling elements 26, and vice versa. The engaging surfaces 40 and 48 on the front and back of each element are generally equidistant from the respective inner edges of the tapes 20 and 22; thus camming forces transverse the elements due to the crosswise forces on the tapes cancel and pivotal forces on the elements are substantially reduced. The triangular shape of the head 30 with the surfaces 40 and 48 extending at substantially the same angle or slope producing in-line coupling provides a more efficient coupling between the elements 24 and 26 as well as more uniform stress loading of the elements.

Figure 9:
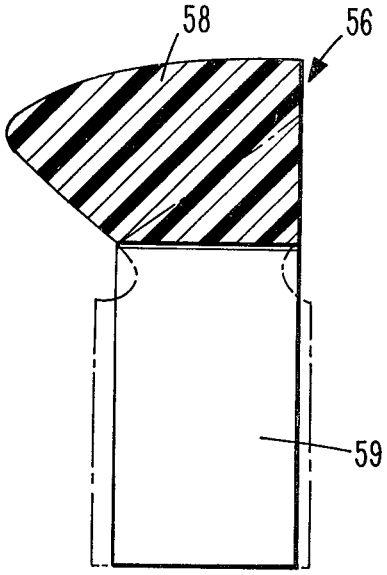
FIG. 9 is a side cross section view of a blank used in forming the coupling element of FIGS. 2–5 and 8.

The coupling elements 24 and 26 are formed from a synthetic polymer resin, such as one of the thermoplastic resins, nylon 6, nylon 6—6, polypropylene, polyethylene, polyester and acetal. As shown in FIG. 9, the coupling element is initially formed in a blank indicated generally at 56 which has a head portion 58 and leg portions (only one leg portion 59 of two leg portions shown). The blank has an excess of synthetic resin in the head portion 58 such as in the area where the recess 46 is to be formed. Then the blank 56 is reformed, as indicated by the dashed lines, into the configuration of the coupling element of FIGS. 2–7 by molding to extrude the excess synthetic resin from the head portion 58 downward through neck sections 60 and 62, FIGS. 3, 4 and 8, of the legs 32 and 34 adjacent the head 30. As indicated by the arrows 65 the extrusion produces laminar flow (i.e., flow in one direction) of the resin downward through the neck sections 60 and 62. Further, the molding die has constrictions in the front and back of the neck sections 60 and 62 to form indents 64 and 66 which reduce the cross sectional area of the neck sections 60 and 62 increasing the rate of laminar flow of the flowable resin material through the neck portions 60 and 62. Alternately the leg portions of the blank may have an excess of polymer resin while the head portion is deficient; the laminar flow being upward rather than downward through the neck portions 60 and 62.

Synthetic polymer resins have long chain molecules which are believed to be oriented during the laminar flow of the plastic resin to produce an orientation of the long chain molecules along the direction of the laminar flow. Additionally the laminar flow of the synthetic polymer resin may result in stratification in the crystalline structure of the polymer resin. Such orientation or stratification results in substantially increased tensile strength of the neck sections 60 and 62 of the legs 32 and 34 adjacent to the head 30; thus the chance of breakage of the coupling elements at the neck portions 60 and 62, where the greatest amount of forces are concentrated during use of the slide fastener, is greatly reduced. The reduced neck section 60 and 62 also increase the flexibility of the head 30 making operation of the slide fastener easier than if such sections were not reduced.

Figure 10:
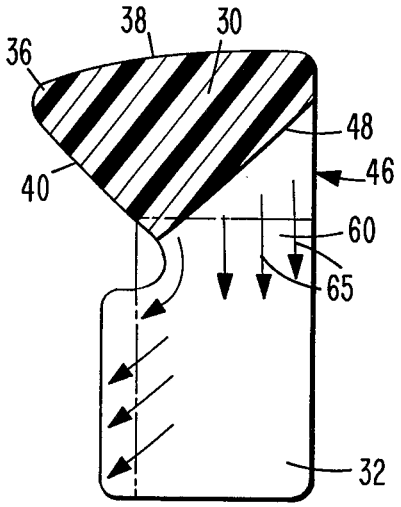
FIG. 10 is a side cross section view of a variation of the coupling element.
Figure 11:
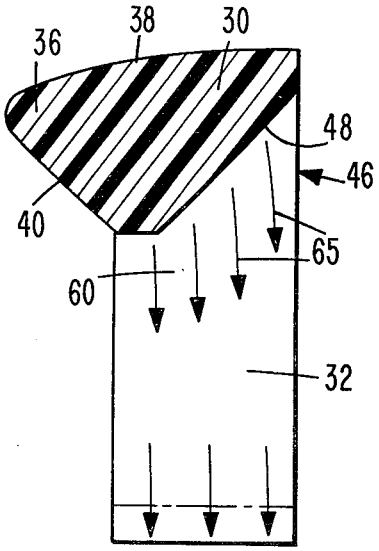
FIG. 11 is a side cross section view of another variation of the coupling element.

Variations of the coupling elements are illustrated in FIGS. 10 and 11 wherein numbers used to identify parts of the coupling element in FIGS. 2–5 and 8 are used to identify substantially identical parts of the variations in FIGS. 10 and 11. In the coupling element of FIGS. 2–5 and 8 the excess of the molded material from the head portion is extruded through the neck sections 60 and 62 into the leg portions which are then expanded both forwardly and rearwardly. In the variation of FIG. 10 the legs are expanded only to the front, while in the variation of FIG. 11 the legs are expanded downwardly.

Also, the coupling elements can be made by a continuous molding process wherein they are molded in a flat configuration joined by connecting threads embedded in the legs of the coupling elements; the legs subsequently being bent into the U-shape of the elements illustrated herein.

Since many variations, modifications, and changes in detail may be made to the described coupling elements and slide fastener and their method of manufacture, it is intended that all matter in the foregoing description and shown in the accompanying drawings be interpreted as illustrative and not in a limiting sense.

What is claimed is:

1. A synthetic polymer coupling element for a slide fastener comprising an interlocking head, a pair of generally parallel legs extending downward from opposite sides of the head, said head and said pair of legs being initially formed in a flowable synthetic polymer resin blank wherein one of said initially formed head and said initially formed pair of leg portions has an excess of flowable resin, and said excess material being laminarly extruded through portions of the legs adjacent to the head to orient the polymer in the portions of the legs adjacent the head.

2. A synthetic polymer coupling element as claimed in claim 1 wherein the portions of the legs adjacent to the head have a substantially smaller cross sectional area than the remaining portions of the legs.

3. A chain for a slide fastener comprising a pair of carrier tapes;

a pair of pluralities of synthetic polymer interlocking coupling elements;

each of the coupling elements having a pair of parallel spaced elongated legs secured to and extending perpendicular to the inner edges of the tapes;

further each of the coupling elements having a head supported by the pair of legs spaced from the respective inner edges of the tapes;

each head having a side cross section with a generally triangular shape defined by a top surface of the head generally parallel to the inner edges of the tape, and a pair of bottom surfaces of the head extending in equal and opposite angles away from the respective inner edges of the tapes;

further each head having a tapered locking protrusion on the front thereof and having a locking recess in the back thereof for receiving the locking protrusion of a mating head portion;

each of said locking protrusions being defined by the respective top surface, one of the respective pair of bottom surfaces, and a pair of converging side surfaces;

each of said locking recesses being defined at the top by the other of the respective pair of bottom surfaces, at the sides by converging inside surfaces, and the bottom of each recess opening into the space between the respective pair of legs;

said pair of bottom surfaces of each head converging at a point adjacent a front of the respective pair of legs; and each of the pairs of legs having sections adjacent the respective heads with reduced cross section wherein the synthetic polymer is oriented longitudinally relative to the legs.

4. A coupling element for a slide fastener comprising a head, a pair of parallel legs extending in spaced relationship from the opposite sides of the head and defining a slot therebetween, said head having a side cross section which is generally triangular and bounded by a top surface and two downward converging bottom surfaces which extend at substantially equal angles to the legs, said two bottom surfaces of the head converging at a point adjacent a front of the legs, said head having a tapered protrusion from the front thereof bounded on the bottom by one of the two bottom surfaces and bounded on the top by the top surface of the head, said head having a recess in the rear thereof with a top of the recess bounded by the other of the two bottom surfaces, and said recess opening at its bottom into the slot between the legs whereby the slot extends up to the bottom surfaces.

5. A coupling element as defined in claim 4 wherein the coupling element is formed from a flowable synthetic polymer resin blank having a head portion and a pair of leg portions wherein one of the head portions and the pair of leg portions of the blank has an excess of resin, said excess of resin being extruded by laminar flow through neck sections of the legs adjacent to the head to orient the polymer in the neck sections.

6. A coupling element as defined in claim 5 wherein the head portion of the blank has an excess of resin in the space of the recess, and the excess of resin in the recess space is extruded downward through the neck sections.

7. A coupling element as defined in claim 5 wherein the neck sections are formed with a substantially smaller cross sectional area than the rest of the legs.

8. A coupling element as claimed in claim 4 wherein the protrusion has a pair of converging side surfaces, and the recess is bounded by a pair of converging inside vertical surfaces.

9. A coupling element for a slide fastener comprising a head a pair of parallel legs extending in spaced relationship from the opposite sides of the head and defining a slot therebetween, said head having a side cross section which is generally triangular and bounded by a top surface and two downward converging bottom surfaces which extend at substantially equal angles to the legs, said two bottom surfaces of the head converging at a point adjacent a front of the legs, said head having a tapered protrusion from the front thereof bounded on the bottom by one of the two bottom surfaces and bounded on the top by the top surface of the head, said head having a recess in the rear thereof with a top of the recess bounded by the other of the two bottom surfaces, said recess opening at its bottom into the slot between the legs whereby the slot extends up to the bottom surfaces, and said two bottom surfaces of the head having midpoints defining a straight line substantially perpendicular to the legs.

* * * * *